US012674444B2

(12) United States Patent
Mahieux

(10) Patent No.: US 12,674,444 B2
(45) Date of Patent: Jul. 7, 2026

(54) WIPER RING FOR RECIPROCATING COMPRESSOR ROD PACKING

(71) Applicant: Compressor Products International LLC (CPI), Stafford, TX (US)

(72) Inventor: Pascal Mahieux, Colleret (FR)

(73) Assignee: COMPRESSOR PRODUCTS INTERNATIONAL LLC (CPI), Stafford, TX (US)

( * ) Notice: Subject to any disclaimer, the term of this patent is extended or adjusted under 35 U.S.C. 154(b) by 0 days.

(21) Appl. No.: 18/958,005

(22) Filed: Nov. 25, 2024

(65) Prior Publication Data

US 2026/0146594 A1 May 28, 2026

(51) Int. Cl.
*F04B 39/04* (2006.01)
*F04B 39/00* (2006.01)

(52) U.S. Cl.
CPC ..... *F04B 39/041* (2013.01); *F04B 39/0022* (2013.01)

(58) Field of Classification Search
CPC ..... F04B 39/041; F04B 39/0022
See application file for complete search history.

(56) References Cited

U.S. PATENT DOCUMENTS 1,655,853 A * 1/1928 Badeker ..... F16J 15/28 277/545
1,828,178 A * 10/1931 Fox ..... F16J 15/28 277/514
3,733,973 A 5/1973 Elsbett
4,045,036 A 8/1977 Shunta
5,251,915 A 10/1993 Meernik
6,959,930 B2 11/2005 Wood et al.
8,403,334 B2 * 3/2013 Lahrman ..... F16J 9/062 277/435
8,701,620 B2 4/2014 Hofbauer
8,820,750 B2 9/2014 Chiba et al.
9,217,507 B2 12/2015 Mittler et al.
9,316,312 B2 4/2016 Jenness et al.
(Continued)

FOREIGN PATENT DOCUMENTS

CN 103075268 B 2/2015
EP 3093537 B1 4/2019

OTHER PUBLICATIONS

Extended European Search Report for European Patent Application No. 25215203.8 dated Jan. 21, 2026, 9 pages.

*Primary Examiner* — Eugene G Byrd
(74) *Attorney, Agent, or Firm* — Edell, Shapiro & Finnan, LLC

(57) ABSTRACT

A rod packing assembly that includes a wiper ring is disclosed. In one embodiment, a rod packing assembly comprises a first ring, a second ring, a third ring, a first biasing member, a second biasing member, and a third biasing member. The third ring has at least one port, and is positioned between the first ring and the second ring. The first ring, the second ring, and the third ring surround a rod and to scrape a surface of the rod. The first biasing member applies a first force to urge the first ring against the rod, and the second biasing member applies a second force to urge the second ring against the rod. The third biasing member applies at least a third force to urge the third ring against the rod. The first and second rings are arranged to apply forces to urge the third ring against the rod.

20 Claims, 10 Drawing Sheets

(56) References Cited

U.S. PATENT DOCUMENTS

| | | | | |
|---|---|---|---|---|
| 9,810,175 | B2 * | 11/2017 | Feistel | F02F 5/00 |
| 9,856,981 | B2 | 1/2018 | Meacham | |
| 10,125,869 | B2 | 11/2018 | Jenness et al. | |
| 10,197,160 | B2 | 2/2019 | Nakamura et al. | |
| 10,330,198 | B2 | 6/2019 | Chiba et al. | |
| 11,092,238 | B2 | 8/2021 | Machliner et al. | |
| 11,162,585 | B2 | 11/2021 | Mendes De Araujo et al. | |
| 11,199,261 | B2 | 12/2021 | Gray | |
| 11,274,747 | B2 * | 3/2022 | Licht | F16J 1/09 |
| 11,384,837 | B2 | 7/2022 | Han | |
| 11,592,105 | B2 | 2/2023 | Bärenreuter et al. | |
| 11,808,360 | B2 | 11/2023 | Janko-Grasslober et al. | |
| 2004/0227301 | A1 | 11/2004 | Wood | |
| 2011/0204575 | A1 | 8/2011 | Langner et al. | |
| 2012/0061920 | A1 | 3/2012 | Nishiura et al. | |
| 2013/0049305 | A1 | 2/2013 | Miyamoto et al. | |
| 2013/0291824 | A1 | 11/2013 | Feistel | |
| 2015/0240943 | A1 | 8/2015 | Meacham | |
| 2017/0299056 | A1 | 10/2017 | Azevedo et al. | |
| 2023/0228329 | A1 | 7/2023 | Mittler et al. | |
| 2024/0141993 | A1 * | 5/2024 | Hikone | F16J 9/20 |
| 2024/0159229 | A1 | 5/2024 | Lagler | |

* cited by examiner

WIPER RING FOR RECIPROCATING COMPRESSOR ROD PACKING

FIELD OF INVENTION

The present invention relates to the field of reciprocating compressors and, in particular, to techniques for performing oil scraping to prevent crankcase oil from contaminating gas and other components of reciprocating compressors.

BACKGROUND

Reciprocating compressors are positive displacement compressors. A reciprocating compressor generally includes a piston assembly that transfers energy from a crankshaft in a crankcase to gas in a cylinder. A reciprocating shaft, such as a piston rod, that is part of the piston assembly transmits reciprocating motion from the crankshaft to the piston. In order to prevent crankcase oil from contaminating the gas in the cylinder, rod or shaft packing is used along the reciprocating shaft. Rod packing often includes wiper rings disposed around the reciprocating shaft to remove oil from the surface of the reciprocating shaft.

SUMMARY

Techniques for reducing the amount of contamination in a reciprocating compressor are disclosed. These techniques may be embodied as one or more methods, one or more apparatuses, e.g., wiper rings used for piston rod packing, and/or one or more systems, e.g., reciprocating compressors.

In accordance with at least one embodiment, the disclosure is directed to a rod packing assembly that comprises a first ring, a second ring, a third ring, and a plurality of biasing members including a first biasing member, a second biasing member, and at least a third biasing member. The third ring includes at least one port defined therein, wherein the third ring is coupled to the first ring and to the second ring, and is positioned between the first ring and the second ring. The first ring, the second ring, and the third ring are configured to surround a rod and to collectively scrape a surface of the rod. The first biasing member is arranged around the first ring and applies a first force to the first ring to urge the first ring against the rod and against the third ring, thereby urging the third ring against the rod. The second biasing member is arranged around the second ring and applies a second force to the second ring to urge the second ring against the rod and against the third ring, thereby urging the third ring against the rod. The at least one third biasing member is arranged around the third ring, and applies at least a third force to the third ring to urge the third ring against the rod.

According to at least another embodiment, a reciprocating compressor comprises a piston assembly including a piston and a piston rod, a crankcase containing a crankshaft and oil, and a wiper ring positioned around the piston rod such that the piston rod moves along a first axis through the wiper ring. The piston rod is coupled to the piston and to the crankshaft, and the oil from the crankcase coats the piston rod. The wiper ring is arranged to scrape the surface of the piston rod to remove the oil from the piston rod as the piston rod moves along the first axis. The wiper ring includes a first outer ring, a second outer ring, an inner ring sandwiched between the first outer ring and the second outer ring, and a plurality of biasing elements. The inner ring has a plurality of ports defined therein. The plurality of biasing elements includes a first biasing member arranged to apply a first inward force to urge the first outer ring against the piston rod, a second biasing member arranged to apply a second inward force to urge the second outer ring against the piston rod, and at least one third biasing member arranged to apply a third inward force to urge the inner ring against the piston rod. The first inward force and the second inward force also urge the inner ring against the piston rod, and wherein the oil removed from the piston rod is provided to the inner ring and directed through the plurality of ports.

Among other advantages, using biasing members on the first and second rings to urge the third ring against the rod may ensure that the three rings maintain contact with one another to prevent leakage between the rings. The combination of three rings utilized for the wiper ring/rod packing assembly enables this enhanced biasing force while still allowing the plurality of ports to be provided unobstructed to allow suitable drainage/oil collection via the ports.

In accordance with still another embodiment, a reciprocating compressor includes a piston assembly, a crankcase, and a packing ring assembly. The piston assembly includes a piston and a piston rod. The crankcase contains a crankshaft and oil, wherein the piston rod is coupled to the piston and to the crankshaft, and wherein the oil coats the piston rod. The packing ring assembly is positioned around the piston rod such that the piston rod moves along a first axis through the packing ring assembly. The packing ring assembly includes a first assembly having a plurality of scraping surfaces arranged to be forced against a surface of the piston rod to scrape the surface of the piston rod to remove the oil from the piston rod as the piston rod moves along the first axis. The packing ring assembly is further arranged to capture the oil removed from the piston rod and to direct the oil removed from the piston rod through the packing ring assembly to return the oil removed from the piston rod to the crankcase. Among other advantages, multiple scraping surfaces in a ring assembly that can also capture and redirect removed oil may provide efficient scraping and efficient operation.

The aforementioned advantages and other advantages and features will become evident in view of the drawings and detailed description.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention may be carried out. The drawings comprise the following figures.

Like reference numerals have been used to identify like elements throughout this disclosure.

DETAILED DESCRIPTION

Figure 1:
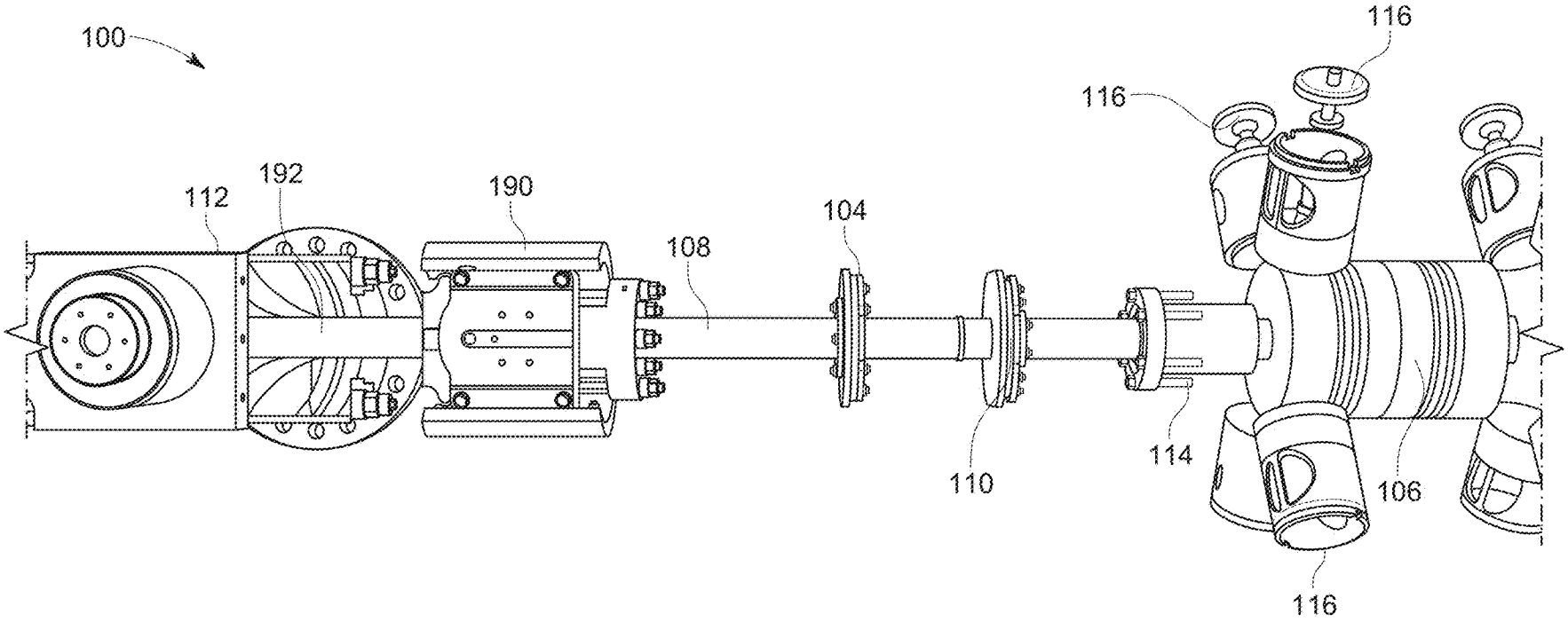
FIG. 1 (PRIOR ART)
FIG. 1 is a diagrammatic representation of a reciprocating compressor.

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is drawn to techniques for preventing a substance such as oil contained in a crankcase of a reciprocating compressor from migrating throughout the reciprocating compressor. These techniques may be embodied as a reciprocating compressor with a wiper ring assembly that includes a plurality of outer rings, an inner ring sandwiched between the outer rings, and a plurality biasing elements that force the outer rings and the inner ring against a piston rod using such that multiple scraping surfaces may scrape oil from the surface of the piston rod while substantially preventing the oil from effectively moving along the piston rod away from a crankcase that contains a crankshaft and oil. The inner ring may be coupled to the outer rings, in part, using features defined in the outer rings which apply an inward force to the inner ring to further force the inner ring against the piston rod. The inner ring may include one or more ports which allow scraped oil captured within the inner ring to be directed through the inner ring towards a conduit that may return the oil to the crankcase.

A reciprocating piston compressor typically utilizes a crankshaft and crosshead that drive a piston rod and piston in different directions along an axis to compress a gas. Within the reciprocating piston compressor, oil is used to lubricate components including the crankshaft and crosshead, which are contained within a crankcase. The use of oil to lubricate the crankshaft and the crosshead enables the crankshaft to move efficiently, and serves to cool the crankshaft and crosshead. As a result, the operation and performance of the reciprocating piston compressor may be improved. However, other, non-piston compressors may also utilize a crankshaft and oil configuration to drive a reciprocating shaft and a piston compressor is merely discussed an example. To be clear, the present application may be implemented in and/or utilized with piston compressors and other compressors of other types.

That said, when a reciprocating compressor operates, oil used to lubricate a crankshaft may effectively move throughout the reciprocating compressor. By way of example, a piston rod of a piston assembly may carry oil downstream of the crosshead assembly within the reciprocating compressor toward the cylinder end of the assembly. When oil is carried throughout the reciprocating compressor, the operation and performance of the reciprocating compressor may be compromised, e.g., pressurization provided by a piston of a piston assembly may be reduced and/or fluid compressed by the piston may become contaminated, as could other sealing components which may come into contact with crankcase oil.

In general, to reduce the amount of oil that may be carried throughout a reciprocating compressor by a piston rod assembly, the oil may be scraped or wiped off of the surfaces of a piston rod of the piston rod assembly. A wiper ring may surround the piston rod, and may be configured to scrape the oil off of the piston rod as the piston rod moves linearly along an axis.

FIG. 1 is a diagrammatic representation of a reciprocating compressor. A reciprocating compressor 100 includes components such as a crankshaft 112, a piston assembly 106 that contains a piston and rider/guide rings, a piston rod 108, and one or more valves 116. Piston rod 108 is coupled to a piston contained within a cylinder (not shown) and to a crosshead 190. One end of piston rod 108 is coupled to crosshead 190 via a connecting rod 192 which is connected at its other end to crankshaft 112. Reciprocating compressor 100 also includes any number or rod packing cases which include packing rings, as for example wiper rod packing case assembly 104, intermediate rod packing case assembly 110, and rod packing case assembly 114. Rod packing case assembly 104 may be a wiper packing case assembly which holds rings configured to scrape or to wipe oil from the surface of piston rod 108. Rod packing case assembly 110 and rod packing case assembly 114 may be configured to generally reduce gas leakage along piston rod 108.

Figure 2:
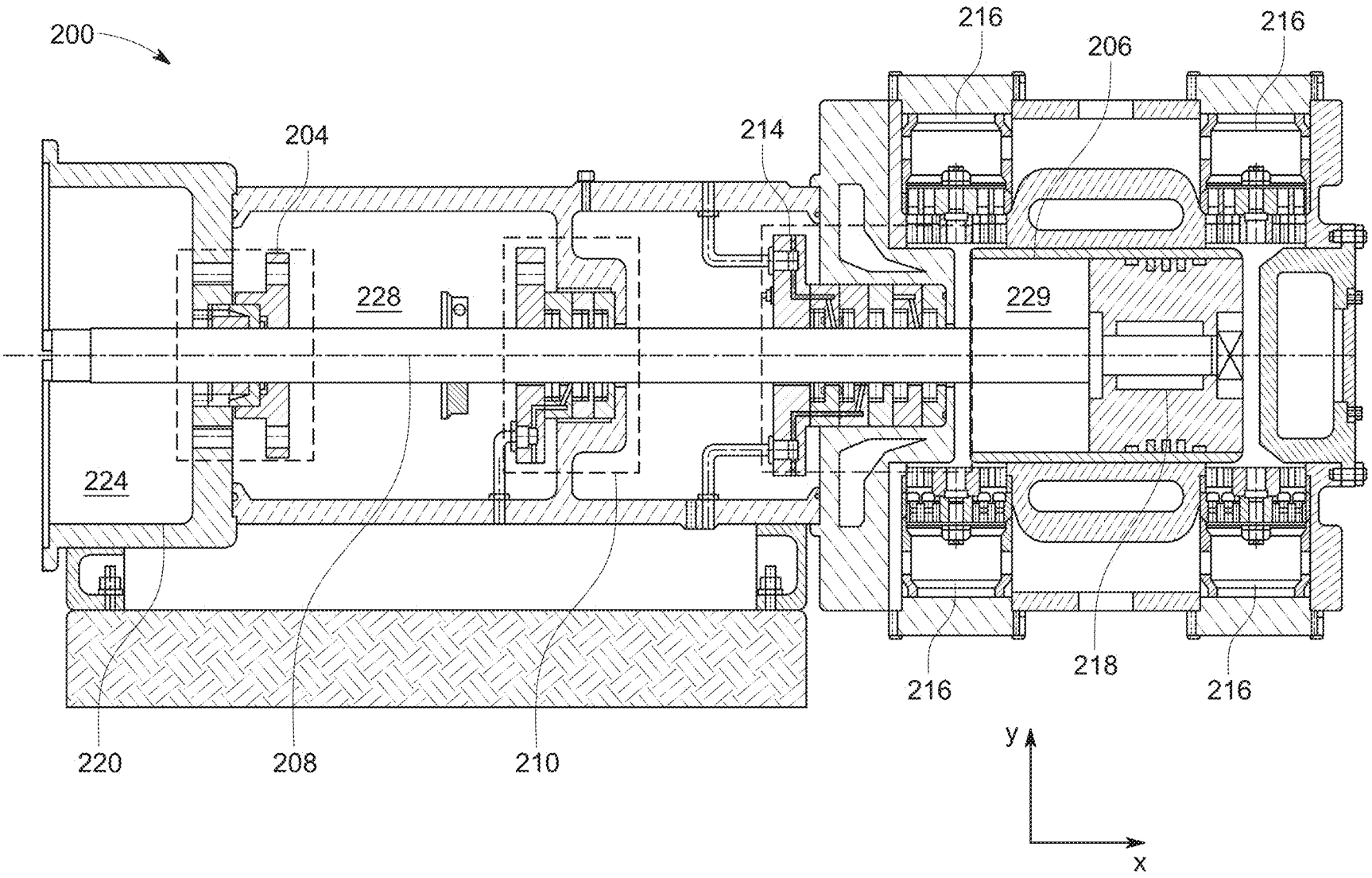
FIG. 2 is a diagrammatic cross-sectional representation of a reciprocating compressor.

FIG. 2 is a diagrammatic cross-sectional representation of a reciprocating compressor. A reciprocating compressor 200 includes a piston assembly that has a piston 218 and a piston rod 208. Piston 218 is generally arranged within a cylinder liner 206. Reciprocating compressor 200 also includes valves 216 (e.g., one-way valves) and a crankcase 220 that contains an oil 224. It should be appreciated that crankcase 220 generally surrounds a crankshaft (not shown) that is coupled to piston rod 208, e.g., through a connecting rod and/or a crosshead (not shown).

Multiple packing rings such as a wiper ring assembly 204, an intermediate packing ring assembly 210, and a main packing assembly 214 may each substantially surround, or be formed around, piston rod 208. Wiper ring assembly 204, in one embodiment, may include an enclosure such as a packing case, a plurality of outer rings, an inner ring with ports or openings defined therein, and a plurality of springs, as will be discussed below. As piston rod 208 moves along an x-axis, or otherwise moves linearly, wiper ring assembly 204 scrapes or wipes oil 224 that is coated onto piston rod 208, e.g., as a film, off the outer surface of piston rod 208 as portions of piston rod 208 move through crankcase 220. When oil 224 that is carried on an outer surface of piston rod 208 is scraped off by wiper ring assembly 204, oil 224 may be prevented from contaminating a gas 229 that is present in cylinder 206 and/or purge gas 228. Purge gas 228 may be, but is not limited to being, a nitrogen purge gas.

In one embodiment, wiper ring assembly 204 may be substantially attached to main packing assembly 214. That is, a case of wiper ring assembly 204 may be substantially attached to a packing case of main packing assembly 214.

Figure 3:
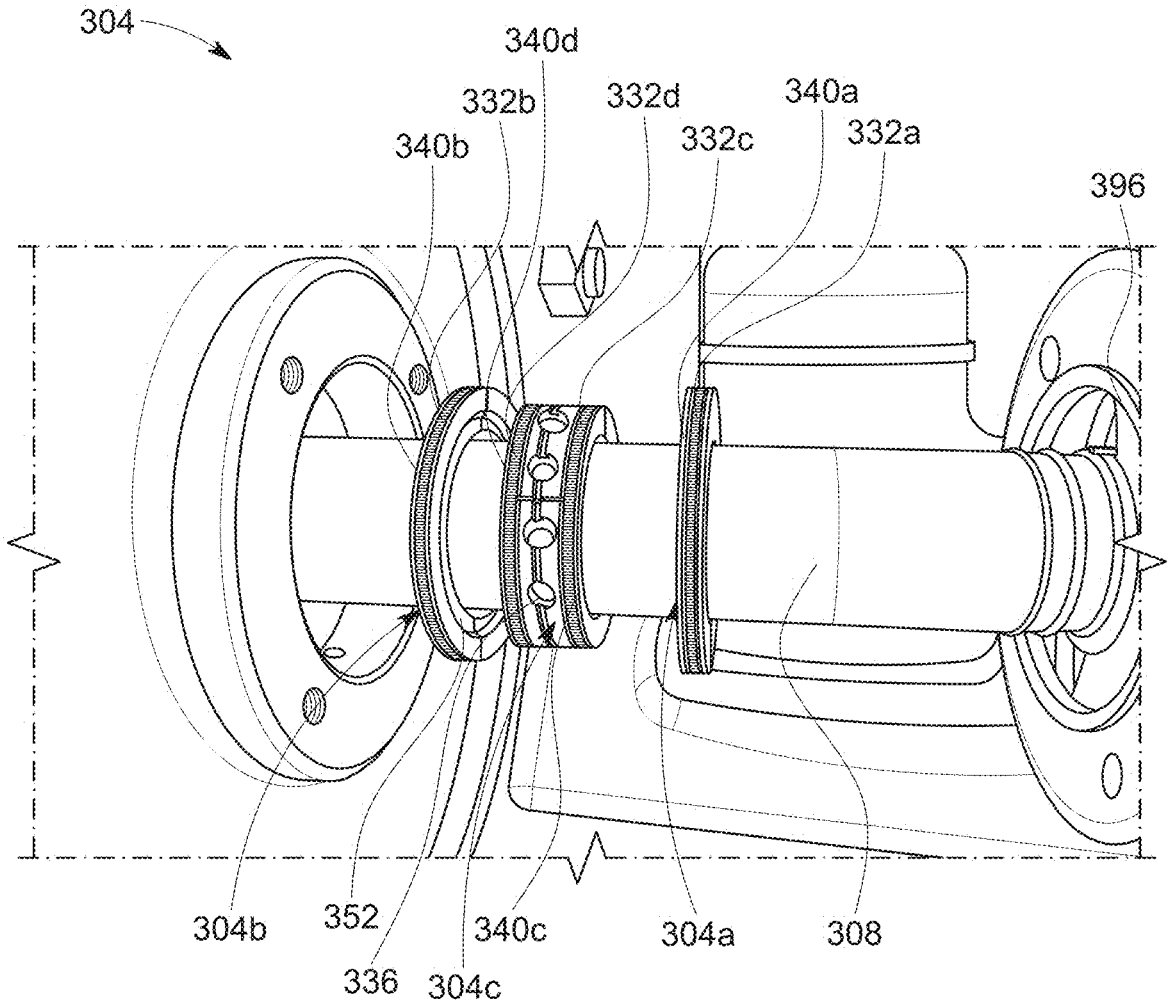
FIG. 3 is a diagrammatic representation of a disassembled wiper ring assembly in accordance with an embodiment.

With reference to FIG. 3, components or a wiper ring assembly will be described in accordance with an embodiment. A wiper ring assembly 304 configured to scrape or to wipe an oil film from a surface of a piston rod 308 is shown in FIG. 3 in a disassembled, or exploded, configuration. It should be appreciated that wiper ring assembly 304 may be contained in an enclosure or a cup 396. Wiper ring assembly 304 surrounds piston rod 308, and includes a first outer ring 304*a*, a second outer ring 304*b*, and an inner ring 304*c*. Inner ring 304*c* is positioned between first outer ring 304*a* and second outer ring 304*b*, and includes a plurality of ports 336 or openings defined therein. The plurality of ports 336 are arranged to direct oil that is scraped by wiper ring assembly 304 substantially through inner ring 304*c*, e.g., and to a crankcase via drain passages in wiper assembly housings and/or cups, etc.

In general, first outer ring 304*a* and second outer ring 304*b* are each arranged to be coupled to inner ring 304*c*, i.e., to substantially opposite sides of inner ring 304*c*, insofar as the term "coupled" and variations thereof are used herein to describe two connected components, e.g., components that are abutting, friction fit together, and/or connected via compression, but do not necessarily require a fastening or secured connection between two parts. First outer ring 304*a* and second outer ring 304*b* each include a feature 352, as shown in second outer ring 304*b*, that is arranged to enable outer rings 304*a*, 304*b* to be coupled to inner ring 304*c*.

First outer ring 304*a* is shaped to enable a first biasing member 332*a* to be supported around an outer surface of first outer ring 304*a*. In one embodiment, first outer ring 304*a* includes an open channel 340*a* or a recess in which first biasing member 332*a* may be substantially disposed or seated. Similarly, second outer ring 304*b* is shaped to enable a second biasing member 332*b* to be supported around an outer surface of second outer ring 304*b*. Like first outer ring 304*a*, second outer ring 304*b* may include an open channel 340*b* or a recess in which second biasing member 332*b* may be disposed.

Inner ring 304*c* is shaped to enable a third biasing member 332*c* and a fourth biasing member 332*d* to be supported around an outer surface of inner ring 304*c*. In one embodiment, inner ring 304*c* may include an open channel 340*c* or recess in which third biasing member 332*c* may be supported and an open channel 340*d* or recess in which fourth biasing member 332*d* may be supported. Each of the aforementioned open channels—e.g., open channels 340*a-d*—may be annular channels that extend entirely around their respective ring.

Biasing members 332*a-d* are generally arranged to apply force on rings 304*a-c* to effectively force or otherwise urge rings 304*a-c* against piston rod 308. Biasing members 332*a-d* may be springs such as garter springs or annular springs, although it should be appreciated that biasing members 332*a-d* are not limited to being springs. Also, springs 322*a-d* may be annular springs that extend entirely around their respective ring, e.g., within their respective open channel 340*a-d*.

Figure 4:
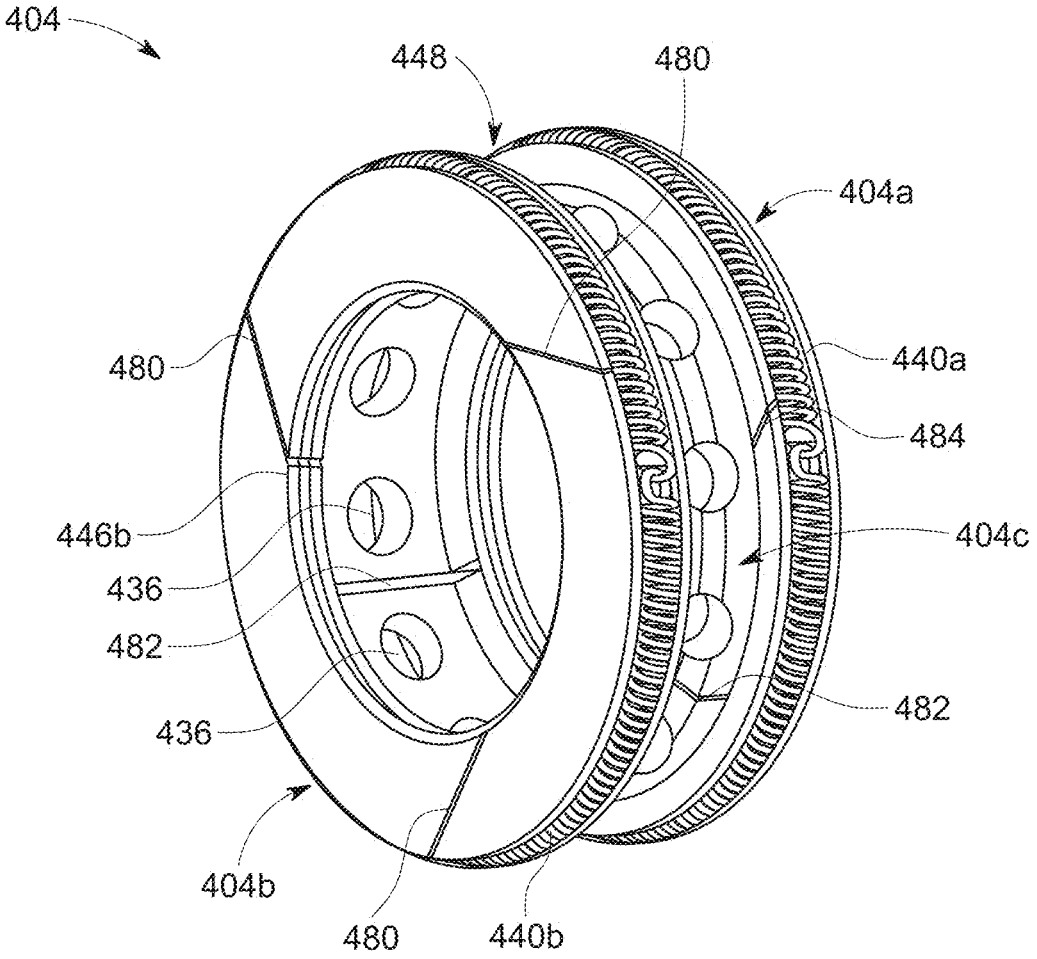
FIG. 4 is a diagrammatic representation of components of a wiper ring assembled together in accordance with an embodiment.
Figure 5:
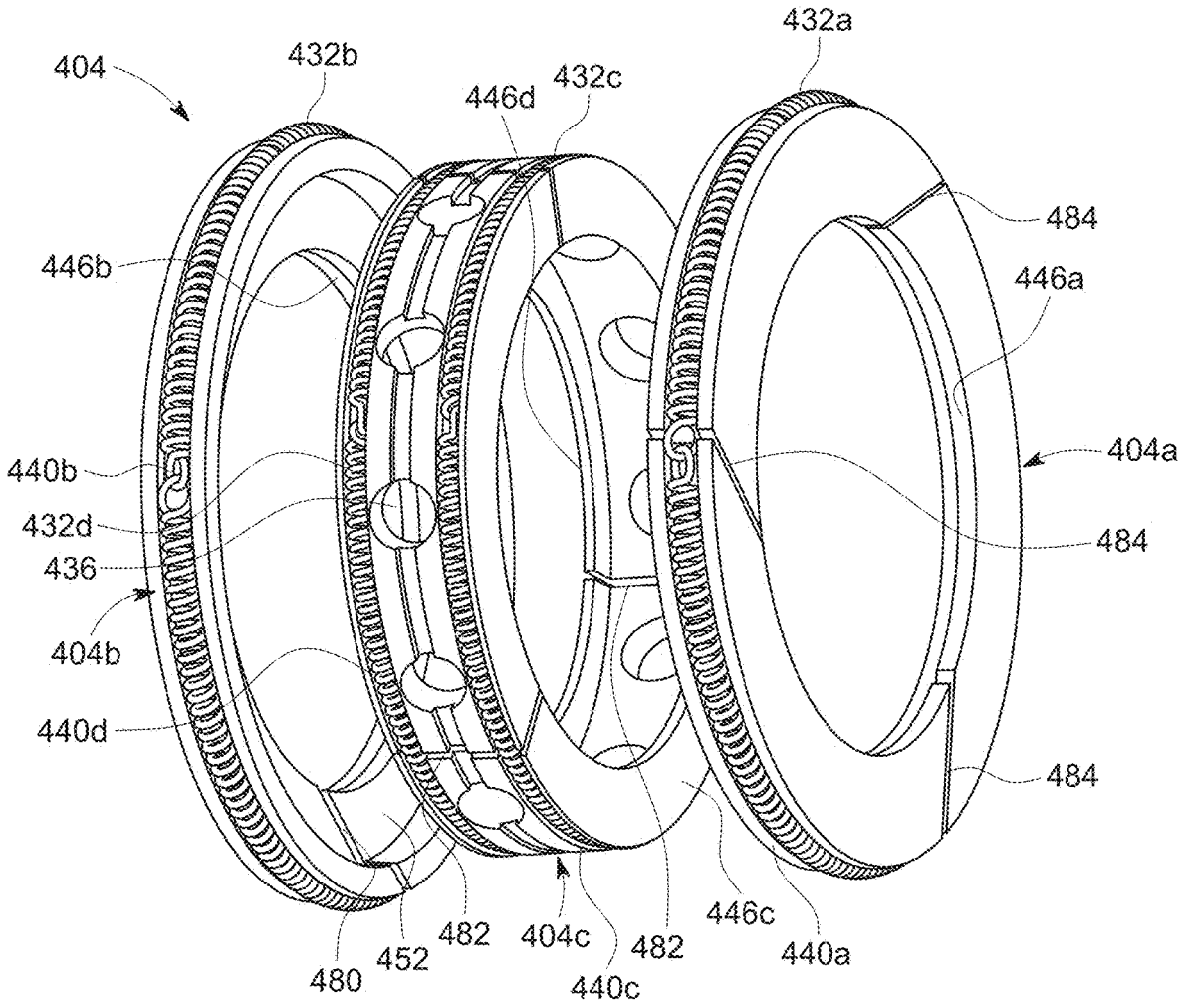
FIG. 5 is a diagrammatic exploded view representation of a wiper ring, e.g., wiper ring 404 of FIG. 4, in accordance with an embodiment.

Referring next to FIG. 4 and FIG. 5, components of a wiper ring assembly will be described in accordance with an embodiment. FIG. 4 is an overall assembled representation of a wiper ring 404, and FIG. 5 is a diagrammatic exploded view representation of wiper ring 404 in accordance with an embodiment. Wiper ring 404 includes a first outer ring 404*a*, a second outer ring 404*b*, and an inner ring 404*c*. When incorporated in a reciprocating compressor, wiper ring 404 may be oriented such that first outer ring 404*a* is on a piston-facing side of wiper ring 404, and second outer ring 404*b* is on a crankcase-facing side of wiper ring 404.

First outer ring 404*a* and second outer ring 404*b* may substantially prevent oil coated on a piston rod (not shown) from passing through wiper ring 404 and/or bypassing wiper ring 404. In other words, first outer ring 404*a* and second outer ring 404*b*, in cooperation with inner ring 404*c*, may facilitate oil drainage and may substantially prevent oil contained in a crankcase of a reciprocating compressor from passing throughout the reciprocating compressor.

First outer ring 404*a* and second outer ring 404*b* each have a feature 452 defined therein which is configured to accommodate inner ring 404*c* to be seated against first outer ring 404*a* and second outer ring 404*b* when first outer ring 404*a* and second outer ring 404*b* are coupled to inner ring 404*c*. Feature 452 may be a recess, groove, indentation, shelf, and/or substantially any structure which may enable portions of inner ring 404*c* to be readily received by first outer ring 404*a* and second outer ring 404*b* when wiper ring 404 is assembled. In at least some instances, feature 452 and/or a portion of inner ring 404*c* configured to engage feature 452 may be tapered to encourage outer rings 404*a* and 404*b* outwards, away from ports included on the inner ring 404*c* to ensure these ports remain unblocked and unobstructed.

First outer ring 404*a* includes a first scraping surface 446*a* that is configured to scrape or to wipe oil from a surface of a piston rod (not shown) around which wiper ring 404 is disposed or otherwise positioned. Second outer ring 404*b* includes a second scraping surface 446*b* that is configured to scrape or to wipe oil from a surface of a piston rod (not shown). Inner ring 404*c* includes a third scraping surface 446*c* and a fourth scraping surface 446*d*. In one embodiment, first scraping surface 446*a* and third scraping surface 446*c* may be arranged to scrape oil from a surface of a piston rod (not shown) when the piston rod moves in a first direction, and second scraping surface 446*b* and fourth scraping surface 446*d* may be arranged to scrape oil from the surface of the piston rod when the piston rod moves in a second direction that is opposite from the first direction. Or, more generally, rings 404*a*-404*c* may collectively scrape a surface of a reciprocating shaft, such as a piston rod, around which the rings 404*a*-404*c* are disposed.

First outer ring 404*a* has a channel 440*a* arranged to accommodate a first biasing member 432*a* such that first biasing member 432*a* is disposed around first outer ring 404*a*. Second outer ring 404*b* has a channel 440*b* arranged to accommodate a second biasing member 432*b*. Inner ring 404*c* has a plurality of ports 436 defined therein, and has a channel 440*c* arranged to accommodate a third biasing member 432*c* as well as a channel 440*d* arranged to accommodate a fourth biasing member 432*d*. Ports 436 are defined along a circumference of inner ring 404*c*. It should be appreciated that the number, size, and shape of ports 436 may vary widely depending upon, for example, the requirements of a particular reciprocating compressor of which wiper ring 404 is a part.

Biasing members 432*a-d* may be springs such as garter springs, e.g., extension garter springs that are configured to apply inward radial forces with respect to wiper ring 404. As a result, the oil scraping or wiping capabilities of wiper ring 404 may be enhanced. That is, the ability of first scraping surface 646*a*, second scraping surface 646*b*, third scraping surface 646*c*, and a fourth scraping surface 646*d* to cause oil to be removed from the surface of a piston rod (not shown) is improved by the inclusion of biasing members 432*a-d* in wiper ring 404. For example, biasing members 432*a-d* may compress the wiper ring 404 against a piston rod (not shown) so that oil is less likely to migrate along a piston rod (not shown) past wiper ring 404 when scraping surfaces 646*a-d* are effectively forced against the piston rod.

Biasing member 432*a*, when positioned in channel 440*a*, is arranged to force, to bias, or to otherwise urge first outer ring 404*a* against a piston rod (not shown). Similarly, when biasing member 432*b* is positioned in channel 440*b*, biasing member 432*b* effectively forces, biases, or urges second outer ring 404*b* against a piston rod (not shown). Biasing member 432*c* and biasing member 432*d* are positioned in channel 440*c* and channel 440*d*, respectively, to effectively force, bias, or urge inner ring 404*c* against a piston rod (not shown). When inner ring 404*c* is coupled to first outer ring 404*a* and second outer ring 404*b*, first outer ring 404*a* and second outer ring 404*b* also apply an inward force on inner ring 404*c*, thereby forcing or urging inner ring 404*c* against a piston rod (not shown). The inward forces applied by biasing members 432*a-d*, and the inward force applied to inner ring 404*c* by first outer ring 404*a* and second outer ring 404*b* enhance the ability of wiper ring 404 to scrape or wipe oil off of a piston rod (not shown). That is, additional inward forces facilitate the ability of scraping surfaces 464*a-d* to maintain contact with a piston rod (not shown) to scrape or wipe oil off of the piston rod.

Inner ring 404*c* may substantially function as a reservoir when coupled to, or sandwiched between, first outer ring 404*a* and second outer ring 404*b*. For example, inner ring 404*c* may cooperate with first outer ring 404*a*, second outer ring 404*b*, and an enclosure (not shown) to form a reservoir. Such a reservoir may be coupled to a conduit which may provide oil from the reservoir to a crankcase, or otherwise facilitate the drainage of oil through the conduit to the crankcase.

When wiper ring 404 is assembled, first outer ring 404*a* and second outer ring 404*b* are offset from each other such that a gap 448 is substantially defined along a portion of inner ring 404*c*. Gap 448 is configured to expose ports 436 to facilitate sufficient oil flow through inner ring 404*c*, and to reduce overflow or blockage of oil within inner ring 404*c*. That is, gap 448 is carefully sized to encourage efficient flow through ports 436.

First outer ring 404*a*, second outer ring 404*b*, and inner ring 404*c* may be formed from any suitable material including, but not limited to including, polymers. For example, in one embodiment, first outer ring 404*a* and second outer ring 404*b* may be formed from polytetrafluoroethylene (PFTE) or polyetheretherketone (PEEK), while inner ring 404*c* may also be formed from PEEK or PTFE. PEEK may be harder than PFTE and, thus, may be relatively stronger while the PTFE is relatively more deformable. However, other materials that create similar relative characteristics may also be utilized. Biasing members 432*a-d* may be formed from materials including, but not limited to including, steel alloys such as stainless steel and carbon steel, as well as bronze alloys.

As shown in FIGS. 4 and 5, first outer ring 404*a* may include one or more tangential cuts 480, second outer ring 404*b* may include one or more tangential cuts 484, and inner ring 404*c* may include one or more radial cuts 482. That is, first outer ring 404*a*, second outer ring 404*b*, and inner ring 404*c* may be segmental. Tangential cuts 480, 482 may be optional, and may have no significant gaps. Radial cuts 482 may be optional, and may have an associated gap.

Figure 6:
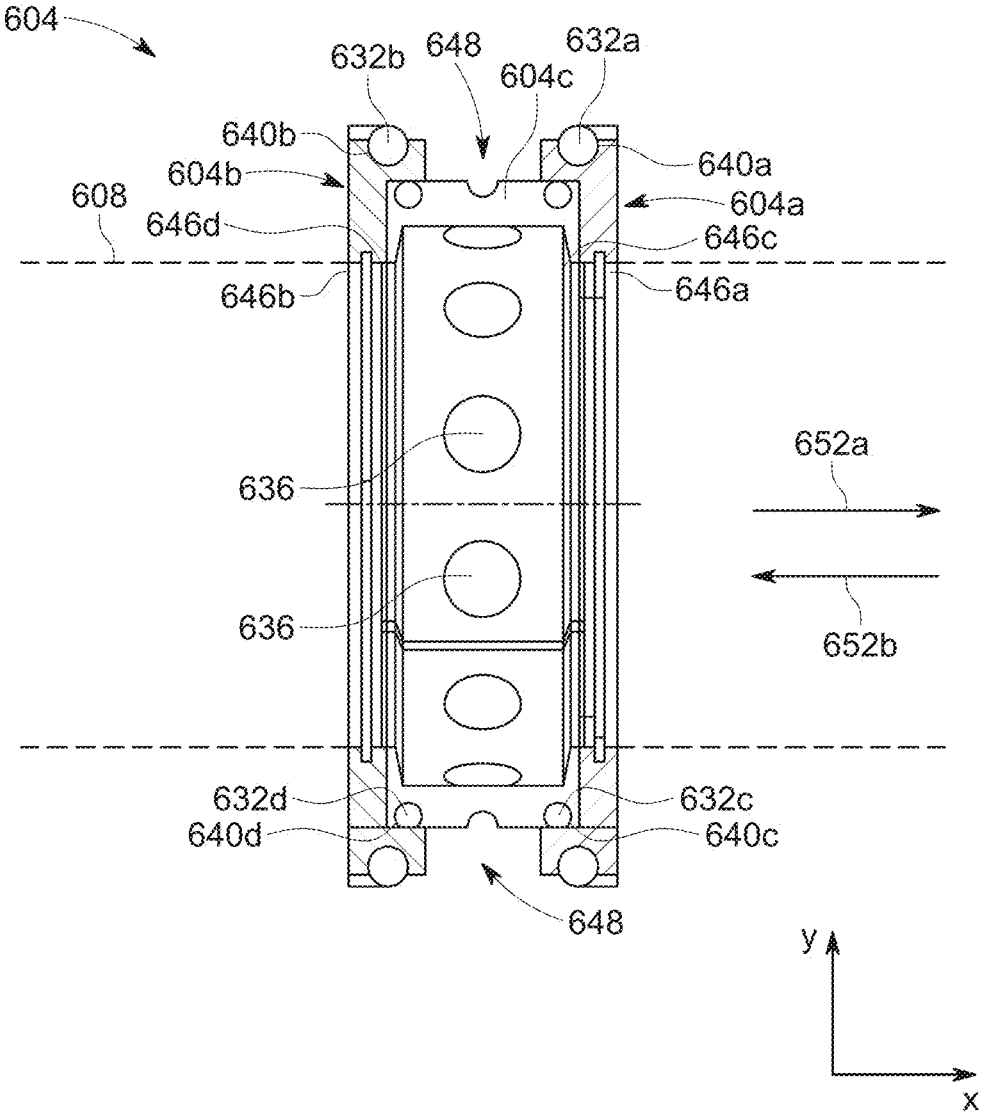
FIG. 6 is a cross-sectional representation of a wiper ring in accordance with an embodiment.

FIG. 6 is a cross-sectional representation of a wiper ring in accordance with an embodiment. A wiper ring 604 substantially surrounds a piston rod 608, i.e., piston rod 608 is arranged to travel through wiper ring 604 along an x-axis. Piston rod 608 may travel in a first direction 652*a* along the x-axis, e.g., away from a crankcase, and/or in a second direction along the x-axis 652*b*, e.g., towards the crankcase.

Wiper ring 604 includes a first outer ring 604*a* that has a first scraping surface 646*a*, a second outer ring 604*b* that has a second scraping surface 646*b*, and an inner ring 604*c* that has a plurality of ports 636 defined therein, as well as a third scraping surface 646*c* and a fourth scraping surface 646*d*. A first biasing element 632*a* is disposed in a first channel 640*a* around first outer ring 604*a*, and a second biasing element 632*b* is disposed in a second channel 640*b* around second outer ring 604*b*. Inner ring 604*c* includes a third channel 640*c* in which a third biasing element 632*c* is disposed, and a fourth channel 640*d* in which a fourth biasing element 632*d* is disposed.

As piston rod 608 moves in a first direction with respect to the x-axis, first scraping surface 646*a* and third scraping surface 646*c* may scrape or wipe oil from piston rod 608. As piston rod 608 moves in a second direction with respect to the axis, or in an opposite direction from the first direction, second scraping surface 646*b* and fourth scraping surface 646*d* may scrape or wipe oil from piston rod 608. However, in at least some instances, the second scraping surface 646*b* and the fourth scraping surface 646*c* may be the primary scraping surfaces because surfaces 646*b* and 646*d* may be the scraping surfaces closest to a crankcase from which the oil to be scraped may emanate (ring 604*b* may be crankcase-facing). In fact, in some instances, the second scraping surface 646*b* may be the primary scraping surface since this surface may be the first scraping surface to encounter oil leaking from the crankcase.

A gap 648 is formed between first outer ring 604*a* and second outer ring 604*b*. Gap 648 enables ports 636 of inner ring 604*c* to be substantially exposed within wiper ring 604 such that oil that is scraped or wiped from piston rod 608 may flow through inner ring 604*c*. Gap 648 may serve as a passage through which oil flow through wiper ring 604 may be facilitated. In at least some instances, outer surfaces of inner ring 604*c* may be tapered to push outer rings 604*a* and outer ring 604*b* outwards and maintain the gap 648 at a distance than spans beyond ports 636.

Figure 7A:
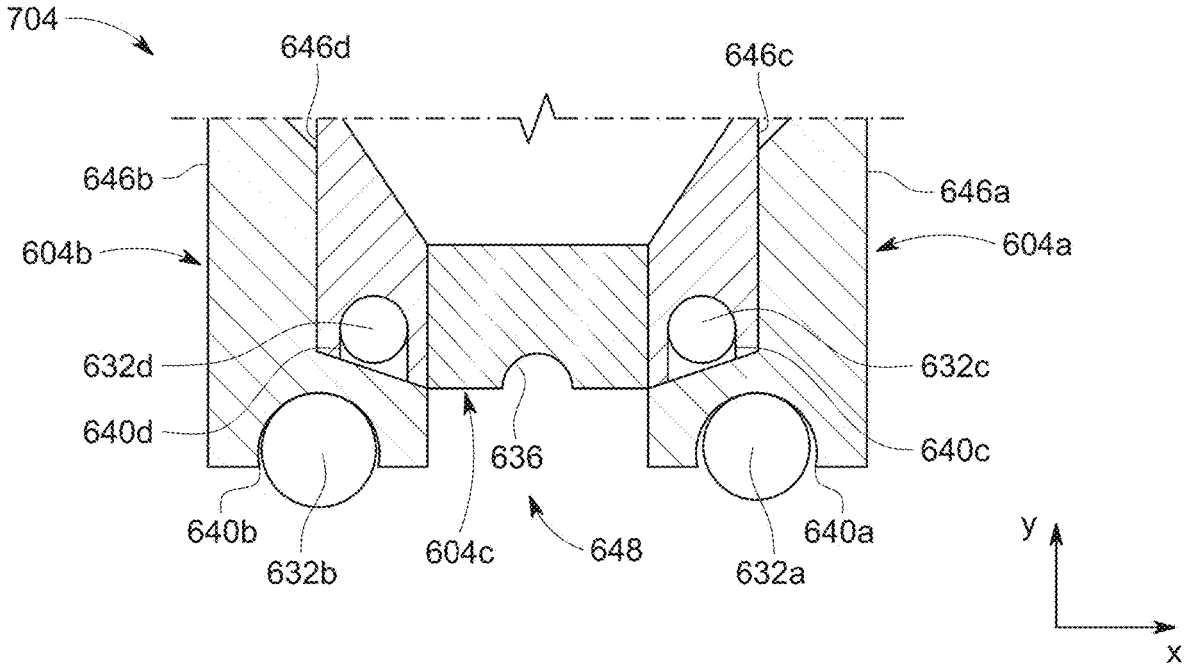
FIG. 7A is a cross-sectional representation of a portion of a wiper ring, e.g., a bottom portion of wiper ring 604 of FIG. 6, in accordance with an embodiment.

Gap 648 is shown in more detail in FIG. 7A, which is a cross-sectional representation of a portion 704 of wiper ring 604 in accordance with an embodiment. The presence of gap 648 enables oil flow through inner ring 604*c* without first outer ring 604*a* and/or second outer ring 604*b* being configured to accommodate the positioning of one or more ports 636. In other words, first outer ring 604*a* and/or second outer ring 604*b* may be configured to address scraping capabilities rather than to address oil flow concerns. As such, the configurations of first outer ring 604*a* and/or second outer ring 604*b* may have any suitable profile without hindering oil flow through inner ring 604*c*.

In one embodiment, the configuration or profile of first outer ring 604*a* and/or second outer ring 604*b* may facilitate gas sealing, e.g., during an operation in which gas is directed through a reciprocating compressor of which wiper ring 404 is a part. Gas sealing may enable gas compressed by the reciprocating compressor to purge gas.

Figure 7B:
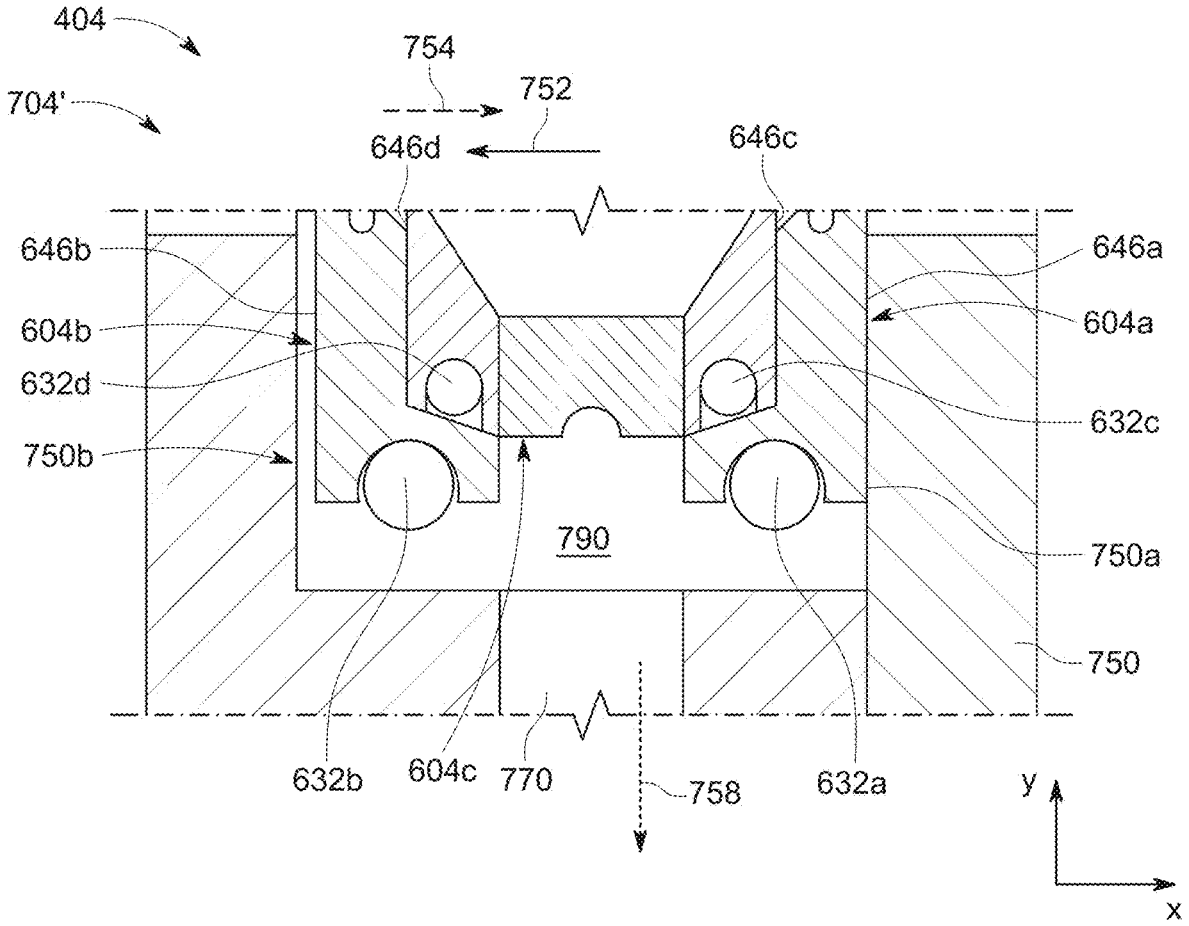
FIG. 7B is a cross-sectional representation of a portion of a wiper ring in a packing case, e.g., the portion 704 of FIG. 7A, shown with an enclosure in accordance with an embodiment.

FIG. 7B is a cross-sectional representation of portion 704 of FIG. 7A as shown with an enclosure or packing case in accordance with an embodiment. Portion 704' includes an enclosure 750 that is arranged to cooperate with first outer ring 604*a* and second outer ring 604*b* to provide gas sealing within portion 704'. First outer ring 604*a* is arranged to substantially abut against an inner surface 750*a* of enclosure 750, as for example when portion 704' is moving in a direction 754.

More specifically, in some instances, the wiper ring 404 spans a lateral dimension (e.g., a dimension spanning the x-axis) that is smaller than a lateral dimension of enclosure 750. Thus, wiper ring 404 can shift laterally within the enclosure 750, at least a small amount, and may move in such a manner in response to movement of a piston rod (e.g., moving with the piston rod). Accordingly, when the piston rod moves the wiper ring 404 towards a piston (not shown) in direction 754, the first outer ring 604*a* may move into contact with the enclosure 750 (as shown) and oil may fill gaps between the wiper ring 404 and the enclosure 750 (e.g., between second outer ring 604*b* and a proximate inner wall 750*b* of enclosure 750). The abutment between outer ring 604*a* and inner surface 750*a* may prevent oil from leaking towards the piston cylinder, e.g., in direction 754, between outer ring 604*a* and inner surface 750*a* while also substantially preventing gas, such as purge gas, from seeping through/between the wiper ring 404 and enclosure 750, e.g., in direction 752.

However, when the piston rod moves towards the crankcase, in direction 752 (opposite direction 754), less oil may be present in the wiper ring 404 (e.g., since oil will be scraped when piston rod moves in direction 754 and reciprocation in direction 752 likely occurs before the piston rod moves back into contact with oil). Thus, when the piston rod moves in direction 752 (e.g., towards the crankcase), the second outer ring 604*b* may move into abutment with the inner surface 750*b* of enclosure 750, forming a seal therebetween. Then, if gas seeps between the enclosure 750 and the wiper ring 404), the gas will be blocked from traveling upstream of the wiper ring 404, i.e., past the wiper ring 404 towards the crankcase.

In short, in addition to its wiping and oil capture functionality, the wiper ring 404 creates a gas seal that essentially blocks gas flow around wiper ring 404. Hence, an amount of gas flow which flows to another part of a reciprocating compressor may be reduced. In one embodiment, first outer ring 604*a* may be shaped to accommodate a profile or contour of inner surface 750*a* in order to enable first outer ring 604*a* to seal against inner surface 750*a* to provide a gas seal having desired qualities. Additionally or alternatively, second outer ring 604*b* may be shaped to accommodate a profile or contour of inner surface 750*b* in order to enable second outer ring 604*b* to seal against inner surface 750*b* to provide a gas seal having desired qualities. It should be appreciated that outer ring 604*a* and *b* may also be shaped to accommodate a profile or contour of an inner surface of enclosure 750.

As oil flows into enclosure 750, the oil may flow through inner ring 604*c*, into a reservoir 790 defined in enclosure 750, and out through an opening 770 in enclosure 750, as indicated by direction 758. Opening 770 may be coupled to at least one oil drainage opening in enclosure 750 and/or conduit (not shown) through which oil may flow to a crankcase.

Figure 8:
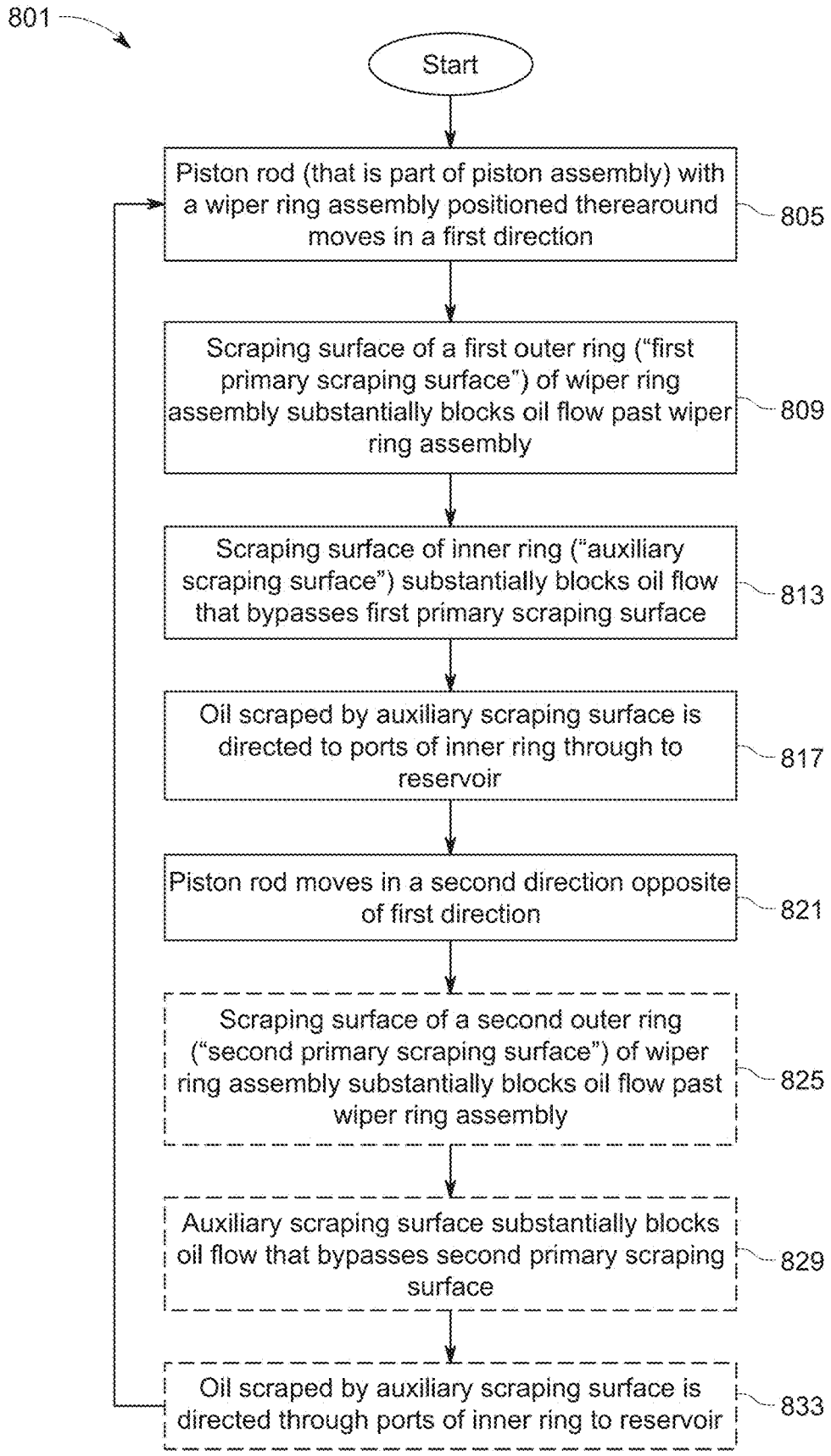
FIG. 8 is a process flow diagram which illustrates a method of utilizing a wiper ring to scrape oil from the surface of a piston rod of a reciprocating compressor in accordance with an embodiment.

Referring next to FIG. 8, the operation of a wiper ring that includes two outer rings and an inner ring with ports formed therein and is part of a reciprocating compressor will be described in accordance with an embodiment. A method 801 of utilizing a wiper ring that is part of a reciprocating compressor to scrape or to wipe a piston rod begins at a step 805 in which a piston rod of a piston assembly moves in a first direction. A wiper ring assembly is positioned about the piston rod, e.g., a wiper ring assembly substantially surrounds the piston rod, such that the piston rod moves through the wiper ring assembly. In one embodiment, the wiper ring assembly is positioned in an enclosure or a cup, and includes a first outer ring, a second outer ring, and an inner ring in which one or more ports are formed. The first direction may be an outward direction in which the piston rod moves away from a crankcase of the reciprocating compressor.

As the piston rod moves in the first direction, a scraping surface of the first outer ring, or the first primary scraping surface of the wiper ring assembly, substantially blocks oil from flowing past the wiper ring assembly by scraping oil from the surface of the piston rod in a step 809. In generally, a majority of the oil flow past the wiper ring assembly may effectively be blocked or scraped by the first primary scraping surface. The oil that is blocked or scraped by the primary scraping surface may be provided to a reservoir formed in an enclosure, e.g., reservoir 790 as shown in FIG. 7, in which the wiper ring assembly is positioned.

A scraping surface of the inner ring, or an auxiliary scraping surface of the wiper ring assembly, substantially blocks oil flow that bypasses the first primary scraping surface in a step 813. That is, the auxiliary scraping surface scrapes oil off of the surface of the piston rod that has not been blocked or scraped by the first primary scraping surface. It should be appreciated that the inner ring may have two auxiliary scraping surfaces, with one auxiliary scraping surface on each side of the inner ring.

In a step 817, the oil scraped by the auxiliary scraping surface is directed through ports of the inner ring, e.g., to a reservoir formed by an enclosure and/or through a conduit to a crankcase of the reciprocating compressor. In other words, the scraped oil is provided through ports of the inner ring to a crankcase.

Once the oil scraped by the auxiliary scraping surface is directed through ports of the inner ring, the piston rod moves in a second direction that is opposite of the first direction in a step 821. In some instances, the wiper assembly continues to scrape oil from the piston rod as the piston rod moves in the second direction, but in other instances, the piston rod may not be coated in oil to be removed when moving in the second direction. Thus, steps 825, 829, and 833 may be considered optional and are depicted in dashed boxes. That said, as the piston rod moves in the second direction, or an inward direction, the scraping surface of the second outer ring, or the second primary scraping surface, of the wiper ring assembly substantially blocks oil flow around the wiper ring assembly in a step 825.

After the second primary surface substantially blocks oil flow, process flow proceeds to a step 829 in which at least one of the auxiliary scraping surfaces blocks oil flow that bypasses the second primary scraping surface. In other words, at least one of the auxiliary scraping surfaces scrapes oil from the surface of the piston rod. It should be appreciated that when the piston rod moves in the second direction, the amount of oil that may remain on the piston rod to be scraped is generally relatively low.

The oil scraped from the surface of the piston by at least one of the auxiliary scraping surfaces is directed through ports of the inner ring in a step 833 to a reservoir or a crankcase. From step 833, process flow returns to step 805 in which the piston rod moves in the first direction.

Figure 9:
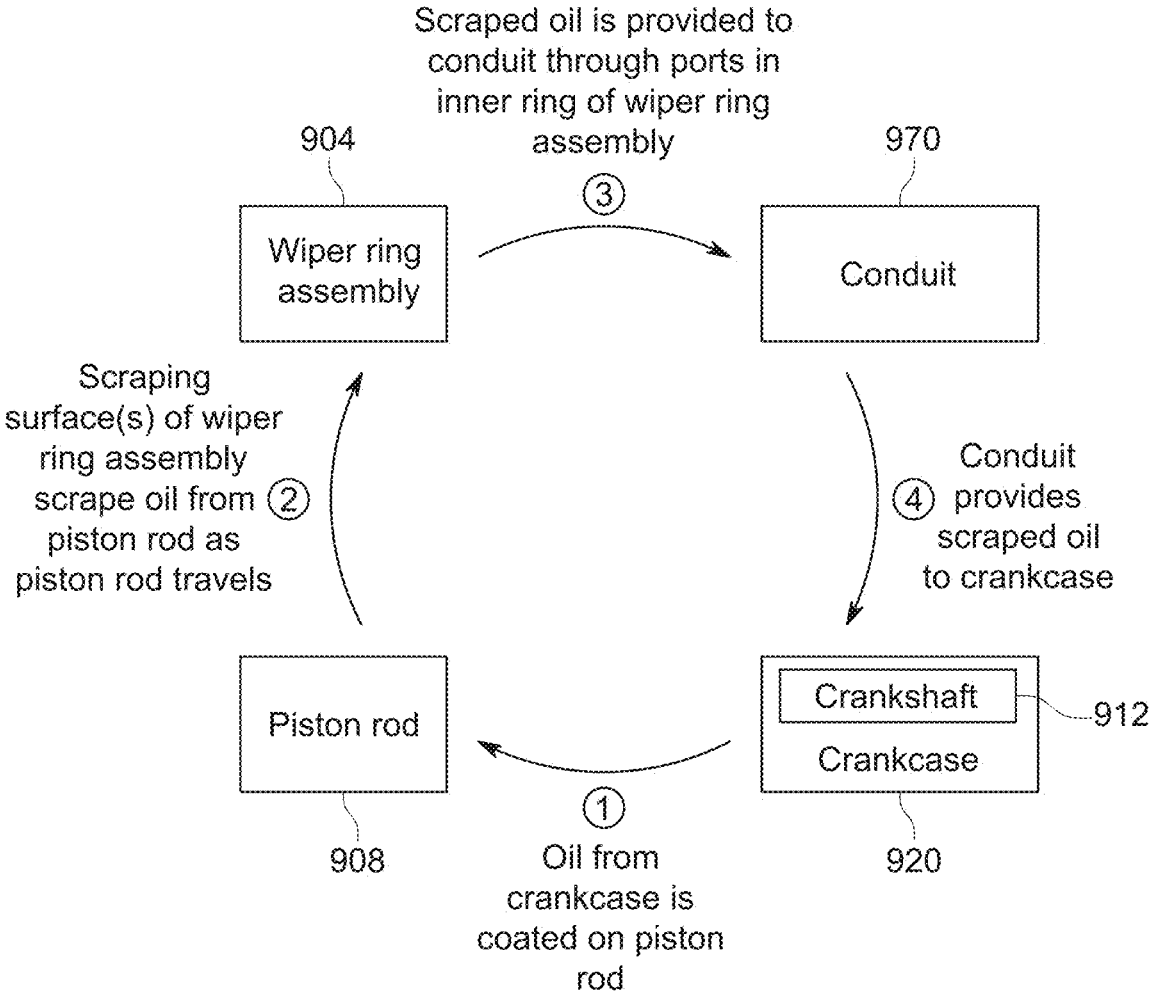
FIG. 9 is a block diagram representation of a process of a scraping oil from a piston rod and returning the oil to a crankcase in accordance with an embodiment.

FIG. 9 is a block diagram representation of a process of a scraping or wiping oil from a piston rod and returning the oil to a crankcase in accordance with an embodiment. At a time T1, oil from a crankcase 912 of a reciprocating compressor that contains a crankshaft 920 is coated onto a piston rod 908 of the reciprocating compressor. The oil is coated onto piston rod 908 as piston rod 908 moves within a crankcase of the reciprocating compressor. That is, the oil forms an oil coating on piston rod 908.

At a time T2, one or more scraping surfaces of a wiper ring assembly 904 of the reciprocating compressor scrapes oil from piston rod 908 as piston rod 908 travels. In one embodiment, wiper ring assembly 904 includes, as described above, two outer rings, an inner ring with one or more ports defined therein, and four biasing members such as springs. It should be appreciated that rings and biasing members of wiper ring assembly 904 may generally be contained within an enclosure, e.g., a packing case, of wiper ring assembly 904.

The scraped oil, or oil coating scraped from a surface of piston rod 908 by wiper ring assembly 904, may be provided to a conduit 970 at a time T3. The scraped oil may be provided through ports in an inner ring of wiper ring assembly 904 to conduit 970, as for example via a reservoir included in wiper ring assembly 904. Conduit 970 provides the scraped oil to crankcase 920 at a time T4. In one embodiment, conduit 970 may be coupled to one or more oil drainage holes of an enclosure of wiper ring assembly 904.

As previously mentioned, biasing members may apply forces to outer rings and an inner ring of a wiper ring to effectively force scraping surfaces of the outer rings and the inner ring against a piston rod. Further, features of the outer rings, e.g., feature 452 of second outer ring 404*b* as shown in FIG. 4, may further force an inner ring against the piston rod. Substantially forcing outer rings and an inner ring against a piston rod may reduce an amount of oil which may pass between the outer rings and the piston rod, and an amount of oil which may pass between the inner ring and the piston rod.

Figure 10:
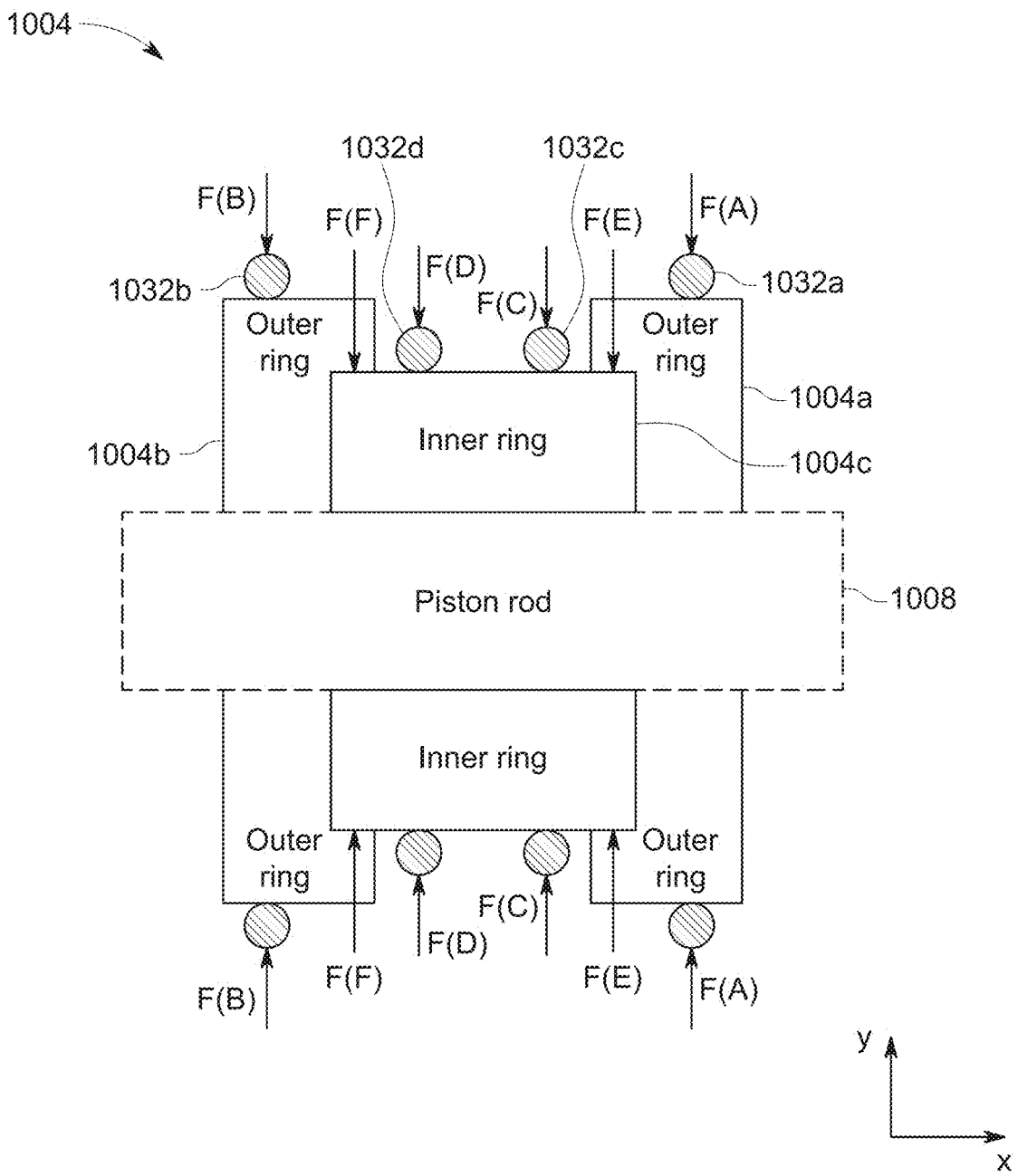
FIG. 10 is a diagrammatic cross-sectional block diagram representation of a wiper ring with components which apply forces on a piston rod in accordance with an embodiment.

With reference to FIG. 10, forces which urge a wiper ring against a piston rod will be described in accordance with an embodiment. A wiper ring 1004 includes a first outer ring 1004*a*, a second outer ring 1004*b*, and an inner ring 1004*c* which are arranged such that a piston rod 1008 may pass through first outer ring 1004*a*, second outer ring 1004*b*, and inner ring 1004*c*.

First outer ring 1004*a*, second outer ring 1004*b*, and inner ring 1004*c* are configured to be in contact with an outer surface of piston rod 1008 such that, as piston rod 1008 moves along an x-axis, scraping surfaces (not shown) of first outer ring 1004*a*, second outer ring 1004*b*, and inner ring 1004*c* may remove oil from the surface of piston rod 1008, as described above. To effectively force or to otherwise urge first outer ring 1004*a*, second outer ring 1004*b*, and inner ring 1004*c* against piston rod 1008, biasing members 1032*a-d* are included in wiper ring 1004. As discussed above, for example with respect to FIGS. 4 and 5, biasing members may generally be situated in channels of outer rings and an inner ring. Channels are not shown in with respect to first outer ring 1004*a*, second outer ring 1004*b*, and inner ring 1004*c* for ease of illustration.

A first biasing member 1032*a* is configured to apply an inward force F(A) along a y-axis that urges first outer ring 1004*a* against piston rod 1008. A second biasing member 1032*b* is configured to apply an inward force F(B) along the y-axis that urges second outer ring 1004*b* against piston rod 1008. Third biasing member 1032*c* is configured to apply an inward force F(C) along the y-axis and fourth biasing member 1032*d* is configured to apply an inward force F(D) along the y-axis that urges inner ring 1004*c* against piston rod 1008.

In one embodiment, the overall configuration or shape of first outer ring 1004*a* and second outer ring 1004*b* enables first outer ring 1004*a* and second outer ring 1004*b* to apply additional forces to inner ring 1004 to further urge inner ring 1004 against piston rod 1008. As described above with respect to FIGS. 4 and 5, a feature, e.g., feature 452, of second outer ring 1004*b* enables inner ring 1004*c* to be seated or otherwise accommodated against second outer ring 1004*b* such that second outer ring 1004*b* overlaps the inner ring 1004*c* and may further force inner ring 1004*c* against a piston rod. Similarly, a feature, e.g., feature 452, of first outer ring 1004*a* enables inner ring 1004*c* to be seated or otherwise accommodated against first outer ring 1004*a* such that first outer ring 1004*a* overlaps the inner ring 1004*c* and may further force inner ring 1004*c* against a piston rod. Put another way, the shapes or contours of first outer ring 1004*a* and second outer ring 1004*b* enable an inward force F(E) and an inward force F(F), respectively, to be applied to inner ring 1004*c* by first outer ring 1004*a* and second outer ring 1004*b* to further force inner ring 1004*c* against piston rod 1008. Among other advantages, overlapping rings may allow for greater spring force against the piston rods while also sealing the separate rings of a wiper ring assembly against each other. This ensure that scraped oil travels through ports of inner ring 1000*c*, e.g., instead of between rings of the assembly.

Although only a few embodiments have been described in this disclosure, it should be understood that the disclosure may be embodied in many other specific forms without departing from the spirit or the scope of the present disclosure. By way of example, outer rings and an inner ring have been described as including one or more channels or grooves that are arranged to substantially contain biasing members such that the biasing members remain disposed around the rings. In some embodiments, biasing members may be disposed around the outer rings and an inner ring without utilizing one or more channels. That is, channels formed in outer rings and/or an inner ring may be optional.

Forces applied to outer rings and an inner ring of a wiper ring to force the wiper ring against a piston rod have generally been described as being applied in a direction along a y-axis. It should be appreciated that forces applied, as for example by biasing members and/or by features of an outer ring, are not limited to being applied in a direction along a y-axis. Forces may have components along other axes, e.g., an x-axis, in addition to, or in lieu of, a component along a y-axis.

In one embodiment, biasing members such as springs may be provided for "side loading," or applying forces to a wiper ring in a direction along an x-axis or a z-axis. Further, a tapered design may be incorporated with respect to a wiper ring to apply forces in a direction along an x-axis or a z-axis. It should be appreciated that the application of side loading to a wiper ring may be in addition to the forces described above.

Materials used to form the outer rings and the inner ring of a wiper ring have been described as including PTFE and PEEK. Other materials, as for example polymer blends or compounds, may generally be used to form outer rings and inner rings.

A reciprocating compressor, as shown above with respect to FIGS. 1 and 2, is oriented in a horizontal configuration. It should be understood that the wiper ring described above is not limited to being incorporated for use with a horizontally oriented reciprocating compressor. For example, the wiper ring described above may be incorporated for use in a vertically oriented reciprocating compressor without departing from the spirit or the scope of the disclosure.

While this application has described the techniques presented herein in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Similarly, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". Finally, for the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The invention claimed is:

1. A rod packing assembly comprising:

a first ring;

a second ring;

a third ring including at least one port defined therein, wherein the third ring is coupled to the first ring and to the second ring, the third ring being positioned between the first ring and the second ring, and wherein the first ring, the second ring, and the third ring are configured to surround a rod and to collectively scrape a surface of the rod;

a first biasing member, the first biasing member being arranged around the first ring, wherein the first biasing member applies a first force to the first ring to urge the first ring against the rod and against the third ring, thereby urging the third ring against the rod;

a second biasing member, the second biasing member being arranged around the second ring, wherein the second biasing member applies a second force to the second ring to urge the second ring against the rod and against the third ring, thereby urging the third ring against the rod; and at least one third biasing member, the at least one third biasing member being arranged around the third ring wherein an outer diameter of the first biasing member or an outer diameter of the second biasing member overlaps the outer diameter of the at least one third biasing member, wherein the at least one third biasing member applies at least a third force to the third ring to urge the third ring against the rod.

2. The rod packing assembly of claim 1 wherein the surface of the rod is coated with a substance, wherein the first ring, the second ring, and the third ring are configured to collectively scrape the surface of the rod to remove the substance.

3. The rod packing assembly of claim 2 wherein the third ring is configured to capture the substance after the substance is removed from the surface of the rod and to direct the substance through at least one port.

4. The rod packing assembly of claim 2 wherein the first ring includes a first scraping surface, the second ring includes a second scraping surface, and the third ring includes a third scraping surface and a fourth scraping surface, the first scraping surface and the third scraping surface being configured to scrape the surface of the rod to remove the substance when the rod moves in a first direction, the second scraping surface and the fourth scraping surface being configured to scrape the surface of the rod to remove the substance when the rod moves in a second direction.

5. The rod packing assembly of claim 1 wherein the first ring includes a first feature and the second ring includes a second feature, the first feature being arranged enable the third ring to be seated against the first ring and to allow the first ring to apply the first force to the third ring, the second feature being arranged to enable the third ring to be seated against the second ring and to allow the second ring to apply the second force to the third ring.

6. The rod packing assembly of claim 1 further including:

a packing case, the packing case having a first surface, wherein the first ring, the second ring, and the third ring are contained within the packing case, the first ring being arranged to cooperate with the first surface to form a seal.

7. A reciprocating compressor comprising:

a piston assembly including a piston and a piston rod;

a crankcase, the crankcase containing a crankshaft and oil, wherein the piston rod is coupled to the piston and to the crankshaft, wherein the oil coats the piston rod; and a wiper ring positioned around the piston rod such that the piston rod moves along a first axis through the wiper ring, the wiper ring being arranged to scrape a surface of the piston rod to remove the oil from the piston rod as the piston rod moves along the first axis, the wiper ring including:

a first outer ring, a second outer ring, an inner ring sandwiched between the first outer ring and the second outer ring, the inner ring having a plurality of ports defined therein, and a plurality of biasing elements, the plurality of biasing elements including a first biasing member arranged to apply a first inward force to urge the first outer ring against the piston rod, a second biasing member arranged to apply a second inward force to urge the second outer ring against the piston rod, and at least one third biasing member arranged to apply a third inward force to urge the inner ring against the piston rod, wherein an outer diameter of the first biasing member or an outer diameter of the second biasing member overlaps the outer diameter of the at least one third biasing member, wherein the first inward force and the second inward force also urge the inner ring against the piston rod, and wherein the oil removed from the piston rod is provided to the inner ring and directed through the plurality of ports.

8. The reciprocating compressor of claim 7 wherein the first outer ring includes a first scraping surface, the second outer ring includes a second scraping surface, and the inner ring includes a third scraping surface and a fourth scraping surface, wherein the first scraping surface and the third scraping surface scrape the surface of the piston rod when the piston rod moves in a first direction along the first axis, and wherein the second scraping surface and the fourth scraping surface scrape the surface of the piston rod when the piston rod moves in a second direction along the first axis.

9. The reciprocating compressor of claim 8 wherein the first scraping surface is a first primary scraping surface, the second scraping surface is a second primary scraping surface, the third scraping surface is a first auxiliary scraping surface, and the fourth scraping surface is a second auxiliary scraping surface, and wherein the first auxiliary scraping surface removes the oil that bypasses the first primary scraping surface and the second auxiliary scraping surface removes the oil that bypasses the second primary scraping surface.

10. The reciprocating compressor of claim 7 further including:

a conduit, the conduit configured to return the oil removed from the piston rod and directed through the plurality of ports to the crankcase.

11. The reciprocating compressor of claim 7 wherein the first outer ring includes a first feature and the second outer ring includes a second feature, the first feature being arranged enable the inner ring to be seated against the first outer ring and to apply the first inward force to the inner ring, the second feature being arranged to enable the inner ring to be seated against the second outer ring and to apply the second inward force to the inner ring.

12. The reciprocating compressor of claim 7 wherein the wiper ring further includes:

a packing case, the packing case having a first surface, wherein the first outer ring, the second outer ring, and the inner ring are contained within the packing case, the first outer ring being arranged to cooperate with the first surface to form a seal.

13. The reciprocating compressor of claim 7 wherein the plurality of biasing elements includes a plurality of springs.

14. The reciprocating compressor of claim 7 wherein the first outer ring and the second outer ring are formed from polytetrafluoroethylene (PFTE), and wherein the inner ring is formed from polyetheretherketone (PEEK).

15. A reciprocating compressor comprising:

a piston assembly including a piston and a piston rod;

a crankcase, the crankcase containing a crankshaft and oil, wherein the piston rod is coupled to the piston and to the crankshaft, wherein the oil coats the piston rod; and a packing ring assembly positioned around the piston rod such that the piston rod moves along a first axis through the packing ring assembly, the packing ring assembly having a plurality of scraping surfaces arranged to be forced against a surface of the piston rod by an inward radial force imposed by a plurality of biasing members that are arranged around outer diameters of packing rings in the packing ring assembly and arranged so that at least two of the plurality of biasing members at least partially overlap, wherein the inward radial force urges the plurality of scraping surfaces to scrape the surface of the piston rod to remove the oil from the piston rod as the piston rod moves along the first axis, the packing ring assembly further being arranged to capture the oil removed from the piston rod and to direct the oil removed from the piston rod through the packing ring assembly to return the oil removed from the piston rod to the crankcase.

16. The reciprocating compressor of claim 15 wherein the packing rings of the packing ring assembly include a first outer ring, a second outer ring, and an inner ring having a plurality of ports defined therein to direct the oil removed from the piston rod to the crankcase, the inner ring being sandwiched between the first outer ring and the second outer ring, and wherein the first outer ring and the second outer ring apply at least a part of the inward radial force to urge the inner ring against the piston rod.

17. The reciprocating compressor of claim 16 wherein the plurality of scraping surfaces includes a first scraping surface, a second scraping surface, a third scraping surface, and a fourth scraping surface, wherein the first outer ring includes the first scraping surface arranged to scrape the surface of the piston rod to remove the oil, the second outer ring includes the second scraping surface arranged to scrape the surface of the piston rod to remove the oil, and the inner ring includes the third scraping surface and the fourth scraping surface arranged to scrape the surface of the piston rod to remove the oil.

18. The reciprocating compressor of claim 17 wherein the first scraping surface is a first primary scraping surface, the second scraping surface is a second primary scraping surface, the third scraping surface is a first auxiliary scraping surface, and the fourth scraping surface is a second auxiliary scraping surface, and wherein the first auxiliary scraping surface removes the oil that bypasses the first primary scraping surface when the piston rod moves in a first direction along the first axis and the second auxiliary scraping surface removes the oil that bypasses the second primary scraping surface when the piston rod moves in a second direction along the first axis.

19. The reciprocating compressor of claim 16 wherein the plurality of biasing members in the packing ring assembly include a first annular spring, a second annular spring, a third annular spring, and a fourth annular spring, the first annular spring being arranged around the first outer ring to generate a part of the inward radial force that urges the first outer ring against the piston rod, the second annular spring being arranged around the second outer ring to generate a part of the inward radial force that urges the second outer ring against the piston rod, the third annular spring being arranged around the inner ring to generate a part of the inward radial force that urges the inner ring against the piston rod, and the fourth annular spring being arranged around the inner ring to generate a part of the inward radial force that urges the inner ring against the piston rod.

20. The reciprocating compressor of claim 19 wherein the first outer ring includes a first channel in which the first annular spring is disposed, the second outer ring includes a second channel in which the second annular spring is disposed, and the inner ring includes a third channel in which the third annular spring is disposed and a fourth channel in which the fourth annular spring is disposed.

* * * * *